US005300912A

United States Patent [19]

Tillery et al.

[11] Patent Number: 5,300,912

[45] Date of Patent: Apr. 5, 1994

[54] ELECTRICAL CUTOUT FOR HIGH VOLTAGE POWER LINES

[75] Inventors: Timothy G. Tillery; Eugene H. Wood; Ronny D. Jergenson; Charles E. Rand; Michael G. Nolte, all of Hickory; Kevin F. Bulson, Charlotte, all of N.C.

[73] Assignee: Utility Solutions, Inc., Hickory, N.C.

[21] Appl. No.: 896,008

[22] Filed: Jun. 9, 1992

[51] Int. Cl.[5] ..... H01H 71/10; H01H 71/08; H01H 71/20

[52] U.S. Cl. ..... 337/180; 174/179; 174/209; 337/168

[58] Field of Search ..... 174/137-212; 337/168-181

[56] References Cited

U.S. PATENT DOCUMENTS

| | | | |
|---|---|---|---|
| 2,961,518 | 11/1960 | Hermann . | |
| 3,594,676 | 7/1971 | Misare | 337/180 |
| 3,868,615 | 2/1975 | Haubein et al. | 337/169 |
| 4,011,537 | 3/1977 | Jackson, Jr. et al. . | |
| 4,045,604 | 8/1977 | Clabburn | 174/179 |
| 4,053,707 | 10/1977 | Ely et al. . | |
| 4,267,402 | 5/1981 | Reighter . | |
| 4,331,833 | 5/1982 | Pargamin et al. . | |
| 4,440,975 | 4/1984 | Kaczerginski | 174/209 |
| 4,714,800 | 12/1987 | Atkins et al. . | |
| 4,774,488 | 9/1988 | Field . | |
| 4,833,278 | 5/1989 | Lambeth . | |
| 4,870,387 | 9/1989 | Harmon . | |

*Primary Examiner*—Harold Broome

*Attorney, Agent, or Firm*—Bell, Seltzer, Park & Gibson

[57] ABSTRACT

An electrical cutout with a modular product design is provided with a constructional configuration for the insulator wherein the insulator is light in weight, has sufficient mechanical strength, can be readily injection molded, and wherein the creep distance is statistically maximized. The electrical cutout has an insulator, an upper and lower line terminal assembly, and a fuse assembly. The insulator has an elongated central stem portion defining a longitudinal direction, and a plurality of longitudinally spaced apart skirts mounted to the stem portion and so as to lie in respective transverse planes which are perpendicular to the longitudinal direction. The elongated central stem portion of the insulator has a non-solid cross-sectional configuration.

48 Claims, 6 Drawing Sheets

ELECTRICAL CUTOUT FOR HIGH VOLTAGE POWER LINES

FIELD OF INVENTION

This invention relates to electrical cutout devices, and more particularly to an electrical cutout for power distribution systems.

BACKGROUND OF THE INVENTION

A cutout or sectionalizer is a protective device having a fuse element that is located between the high voltage power line and the distribution network grid. In the event of a fault due to a high current surge on the power line, the fuse element is designed to blow and instantly remove power from the section of the grid being protected by the cutout. This device keeps the entire grid from going down; thus, power is lost only on the section where the fault occurred.

A cutout is formed of two basic parts: (1) a fuse link holder built around an insulator and (2) a fuse assembly. The fuse assembly pivots downward after a fault current activates and blows the fuse element located within the fuse assembly. When the fuse element activates and the fuse assembly pivots downward, considerable physical force is exerted on the insulator. Hence, the insulator is typically made from porcelain or other ceramic material for added strength to prevent damage when the fuse element activates. These porcelain insulators, however, are usually heavy and bulky, require specialized assembly fixtures or processes, and are awkward to handle and ship. The porcelain insulators, being ceramic, are also brittle and easily chipped or broken.

When the fuse element of a fuse assembly activates, a lineman from a utility company needs only to see which cutout has a fuse assembly hanging in the downward position. From this he can determine which part of the network grid is faulted, locate and fix the cause of the fault, remove the fuse assembly with a hot stick, replace the fuse element inside the fuse assembly, and reinstall the fuse assembly to reenergize the cutout and once again protect the distribution network grid.

Cutouts are not per se new to the electrical distribution industry. Problems, however, have arisen with many conventional cutouts. One such problem occurs when electricity flashes directly from a conducting surface to a grounded surface while the fuse assembly is in the open or closed position. This electricity travel gap between the conducting surface and the grounded surface is called the strike distance. The strike distance in air is fairly well known, thus various size insulators are used to increase this distance.

Another problem with conventional cutouts arises when the electrical current is capable of traveling or creeping along the surface of the insulator directly from the upper end to the lower end and thereby bypass the fuse assembly. This phenomenon occurs when the insulator has an inadequate surface distance. The accumulation of water, dirt, debris, salts, and air pollutants on the insulator surface tends to provide an easier creep path for the electrical current and hence lower the effective surface distance. This surface distance is also called the "leakage," "tracking," or "creep" distance of a cutout.

Current suppliers of cutouts offer numerous insulator sizes that provide different strike and creep distances, as determined by operating voltages and environmental conditions. The higher the voltage across the conductor to be insulated, the longer the creep distance must be in order to prevent flashover or the first problem as described above. Ultimately, there is sufficient change in length to warrant the use of an entirely different length fuse assembly for various voltage classifications. Also, several different insulators with different creep distances are often provided for the same voltage classification to address the second problem as described above. These solutions to the problems, however, have still proven to be inadequate.

Cutouts with plastic or polymeric insulators have been designed in an attempt to overcome some of the failure problems incurred with conventional insulators. None of the prior plastic insulators, however, adequately solved the creep distance, material-electrical compatibility, material weatherability, and mechanical strength problems simultaneously. Some prior cutouts with plastic insulators have only attempted to solve the strength problem while inadequately addressing the creep distance. Such attempts have included plastic insulators with an insulating core material wherein the core material was selected to provide the needed strength. Examples of such cutouts with these type of insulators are U.S. Pat. No. 2,961,518 to Herman entitled "*Circuit Interrupter,*" U.S. Pat. No. 3,868,615 to Haubein et al. entitled "*Current Sensitive Interrupting Terminator Assembly,*" U.S. Pat. No. 4,053,707 to Ely et al. entitled "*Method and Apparatus for High Voltage Insulation,*" U.S. Pat. No. 4,440,975 to Kaczerginski entitled "*Electrical Insulator Including A Molded One-Piece Cover Having Plate-Like Fins With Arcuately Displaced Mold Line Segments,*" U.S. Pat. No. 4,331,833 to Pargamin et al. entitled "*Insulator Comprising A Plurality Of Vulcanized Pins And Method Of Manufacture,*" U.S. Pat. No. 4,714,800 to Atkins et al. entitled "*Stress Control/Insulating Composite Article With An Outer Surface Having Convolutions And Electric Power Cable Terminated Therewith,*" and U.S. Pat. No. 4,870,387 to Harmon entitled "*Beam Strengthened Cutout Insulator.*"

Other prior cutouts attempted to solve the creep distance problem while inadequately addressing the insulator strength and weight problem, such as in U.S. Pat. No. 4,833,278 to Lambeth entitled "*Insulator Housing Made From Polymeric Materials And Having Spirally Arranged Inner Sheds And Water Sheds.*"

Therefore, those concerned with these and other problems recognize the need for an electrical cutout that simultaneously provides the needed strength, creep distance, material-electrical compatibility, and that is also light weight for handling and shipping purposes.

SUMMARY OF THE INVENTION

It is therefore an object of the present invention to provide an improved electrical cutout.

It is another object of the present invention to provide an electrical cutout that allows a complete disassembly of the product, replacement of any component, and reassembly of the product without the need for any specialized fixture, process, or tooling.

It is also an object of the present invention to provide an electrical cutout having an insulator with a non-uniform creep distance from an upper to a lower end thereof.

It is also another object of the present invention to provide an electrical cutout that provides both mechanical strength and maximum creep distance.

It is a further object of the present invention to provide an insulator for an electrical cutout of the described type and which may be injection molded as one part, of thermo-plastic or other polymeric material.

These and other objects and advantages of the present invention are achieved by the discovery of a novel constructional configuration for the insulator of an electrical cutout of the described type, and wherein the insulator is light in weight, has sufficient strength, can be readily injection molded, and wherein the creep distance is statistically maximized. In accordance with this latter feature, the chances that an electrical current creep path is created by the accumulation of water, dirt, debris, salts, and air pollutants on the insulator surface is minimized, while still providing the needed mechanical strength and the other advantages noted above.

The preferred embodiment of the present invention comprises an electrical cutout having an insulator, an upper and lower line terminal assembly, and a fuse assembly. The insulator has an elongated central stem portion defining a longitudinal direction, and a plurality of longitudinally spaced apart skirts mounted to the stem portion and so as to lie in respective planes which are transverse to the longitudinal direction. The elongated central stem portion has a non-solid, multiple segment cross-sectional configuration.

The upper line terminal assembly is mounted to one end of the insulator and includes means for attaching an electrical cable thereto and an upper electrical contact. The lower line terminal assembly is mounted to the other end of the insulator and includes means for attaching an electrical cable thereto and a lower electrical contact.

The upper and lower line terminal assemblies each have a first metallic plate member comprising first and second legs disposed in a generally L-shaped arrangement and so as to define an inside surface on the inside of the L and an opposite outside surface on the outside of the L. The line terminal assemblies also each have a second metallic plate member comprising first and second legs disposed in a generally L-shaped arrangement and which closely conform to the size and configuration of the first plate member, and with the second plate member being secured to the first plate member so as to overlie the outside surface of the first plate member and with the first and second legs of the second plate member respectively overlying the first and second legs of the first plate member. In addition, the line terminal assemblies have clamp means for interconnecting the first and second plate members and for securing the end portion of an electrical cable into direct engagement with the outer surface of the first leg of the second plate member, and such that the second leg of the second plate member is exposed for direct electrical contact with a fuse or the like.

The fuse assembly of the electrical cutout is pivotally mounted to the other end of the insulator for pivotal movement between an operative position engaging and electrically closing the upper and lower contacts and an inoperative position wherein the upper and lower contacts are electrically open.

DESCRIPTION OF A PREFERRED EMBODIMENT

The present invention now will be described more fully hereinafter with reference to the accompanying drawings in which the preferred embodiment of the invention is shown. This invention may, however, be embodied in many different forms and should not be construed as limited to the embodiment set forth herein; rather, this embodiment is provided so that this disclosure will be thorough and complete and will fully convey the scope of the invention to those skilled in the art. Like numbers refer to like elements throughout.

Figure 1:
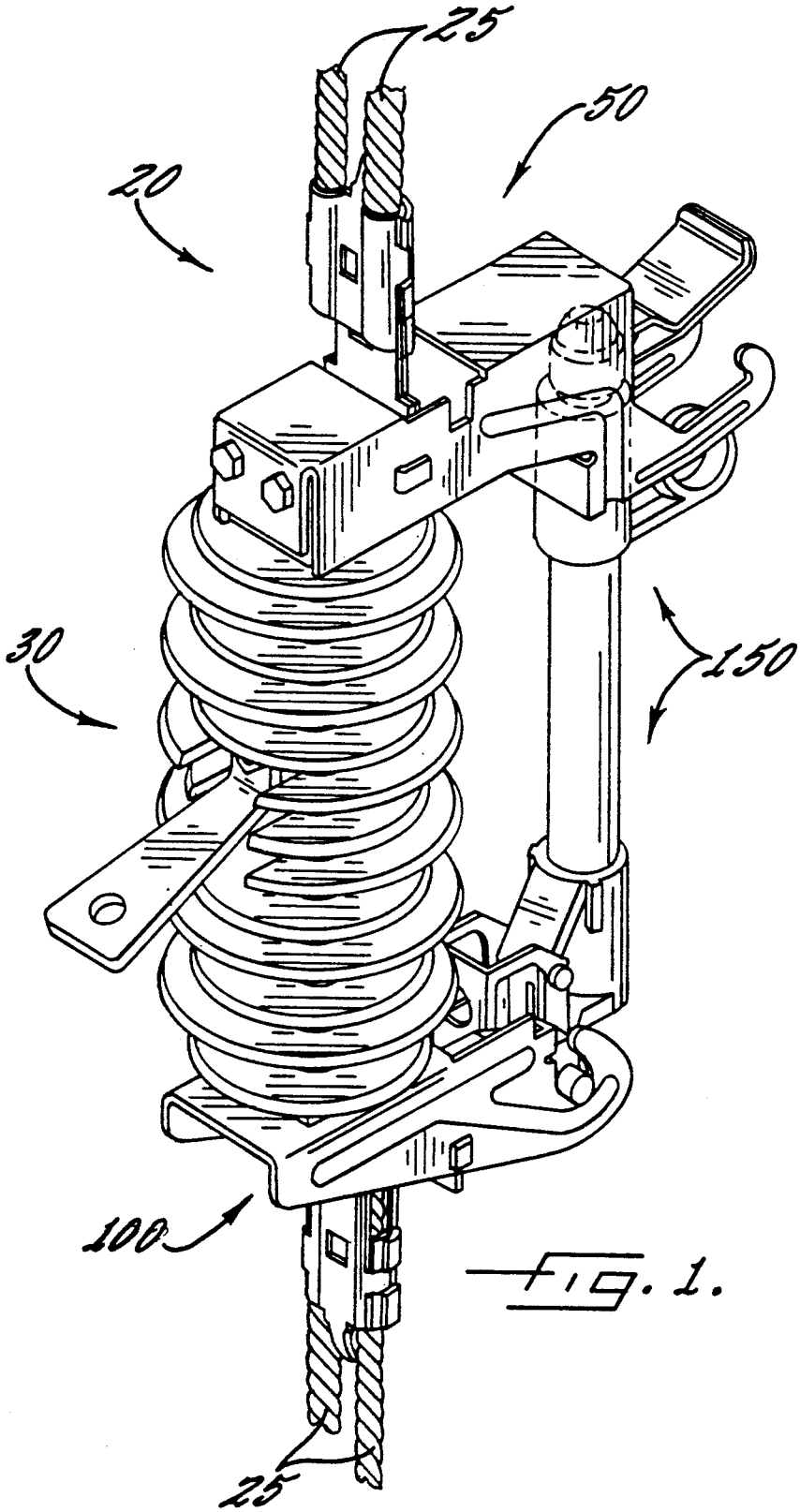
FIG. 1 is a perspective view of the electrical cutout according to the present invention.
Figure 2:
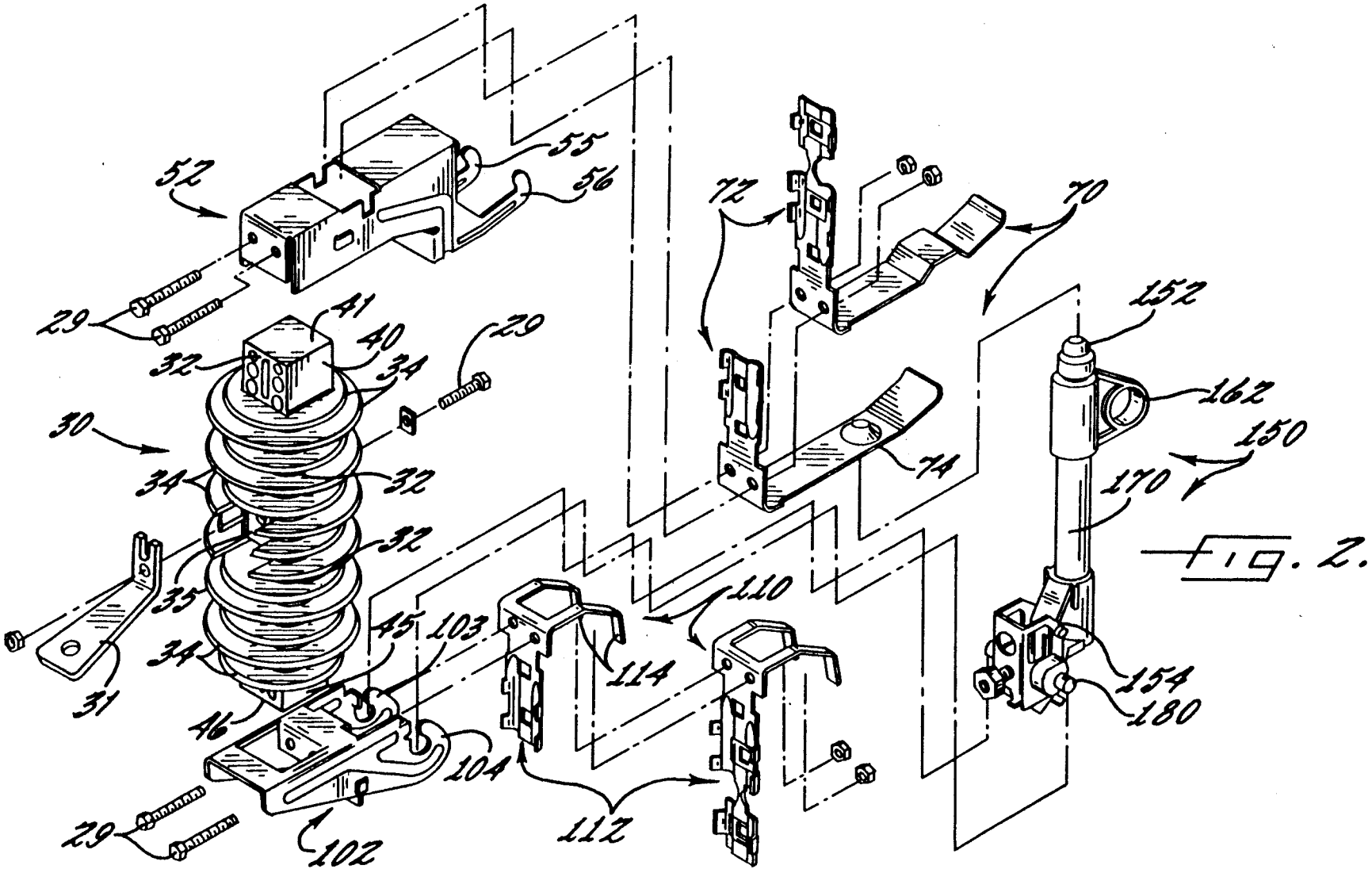
FIG. 2 is an exploded perspective view of the electrical cutout as shown in FIG. 1.

Reference is now made to FIGS. 1 and 2 to describe the parts of the electrical cutout according to the present invention. Referring now to FIG. 1, shown is a perspective view of the electrical cutout 20 connected to high voltage power lines or electrical cables 25 in an assembled and engaged position. The electrical cutout 20 has an insulator 30, an upper 50 and lower 100 line terminal assembly, and a fuse assembly 150.

FIG. 2 is an exploded perspective view of the electrical cutout 20 which is now used to describe the parts of the cutout 20 in more detail. The insulator 30 has an elongated central stem portion 32 defining a longitudinal direction, and a plurality of longitudinally spaced apart skirts 34 mounted to the stem portion 32 and so as to lie in respective transverse plane which, in the illustrated embodiment, are generally perpendicular to the longitudinal direction. Also, the longitudinally space apart skirts 34 are arranged and constructed so as to have a smaller diameter skirt directly above or below a larger diameter skirt.

The upper line terminal assembly 50 is attached to an upper mounting post 40 at one end 41 of the insulator 30 by an upper bracket 52 and includes means 72 for attaching the electrical cables 25 thereto and an upper electrical contact 74 having the form of an upper clamp assembly 70. The upper bracket 52 is attached to the upper mounting post 40 in such a way as to shield water or other fluids from entering the stem portion 32 of the insulator 30 and thereby prevent damage to the insulator 30 in harsh environments. The upper bracket 52 also has guide members 55, 56 for guiding the fuse assembly 150 into engagement with the upper line terminal assembly 50. The guide members 55, 56 also serve as arcing horns. When the fuse assembly 150 is removed, the guide members 55, 56 extinguish any arcing between the fuse assembly 150 and the upper electrical contact 74.

The lower line terminal assembly 100 is attached to a lower mounting post 45 at the other end 46 of the insulator 30 by a lower bracket 102 and includes means 112 for attaching the electrical cables 25 thereto and a lower electrical contact 114 having the form of a lower clamp assembly 110. The lower bracket 102 also has engaging braces 103, 104 for engaging the fuse assembly 150.

Also attached to a cut-away middle portion 35 of the insulator 30 is a middle bracket 31 which attaches to a power line pole or electrical cable pole or the like to aid in securing the cutout 20 to the pole. The upper 52, lower 102, and middle 31 brackets can be detached from the insulator 30 by various bolts 29 to allow ease of replacement or interchangeability of various sized insulators 30 for various fuse assembly 150 lengths. Also, if a bracket is damaged or has other problems, it can be replaced without replacing the entire insulator 30 or electrical cutout 20. This construction and design simplicity allows these changes to be made in the field, with no specialized tools, if necessary.

Figure 3:
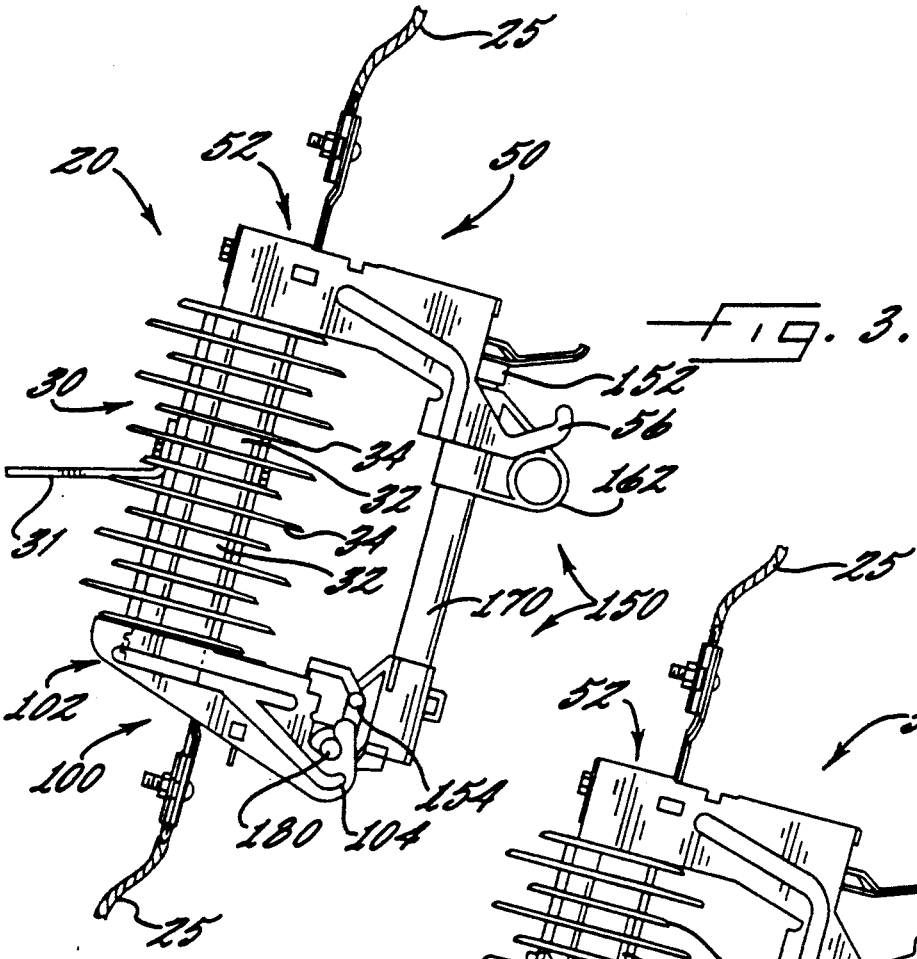
FIG. 3 is a side view of the electrical cutout with the fuse assembly in an operative engaged position.
Figure 4:
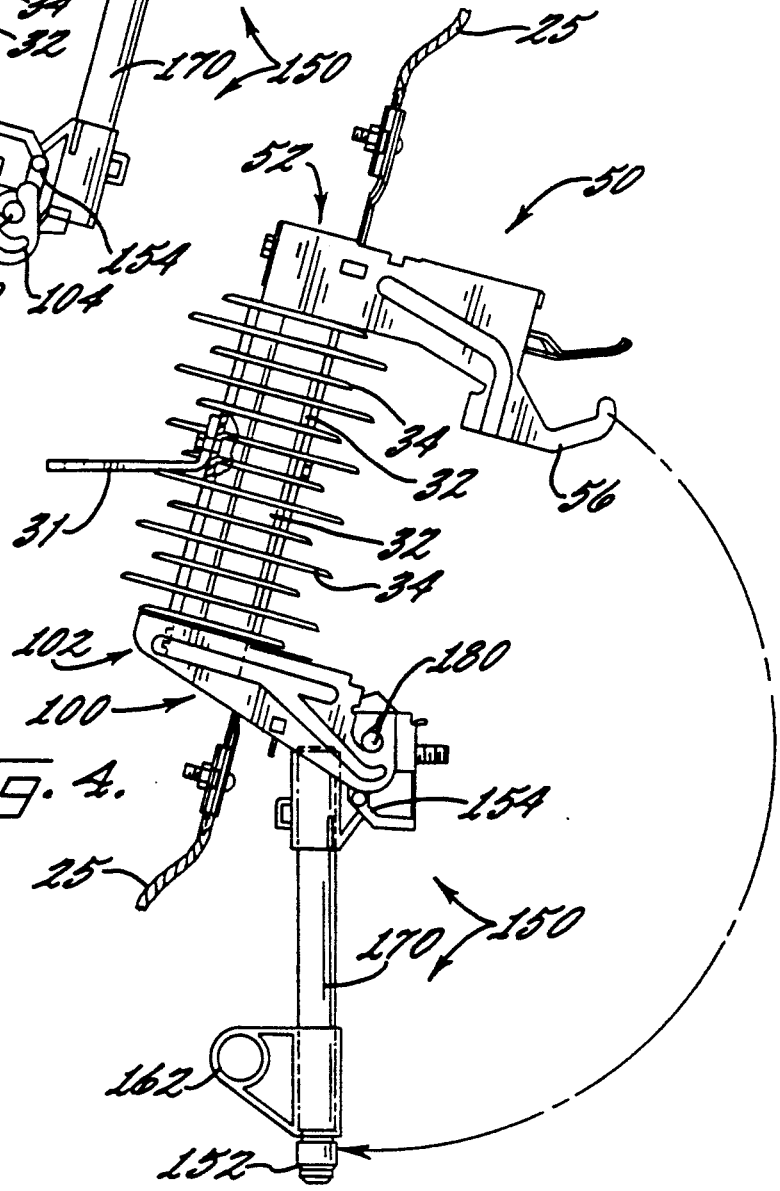
FIG. 4 is a side view of the electrical cutout with the fuse assembly pivotally swinging down into an inoperative disengaged position.

The fuse assembly 150 is pivotally mounted to the other end 46 of the insulator 30 in the engaging braces 103, 104 of the lower bracket 102 for pivotal movement between an operative position engaging and electrically closing the upper 74 and lower 114 contacts and an inoperative position wherein the upper 74 and lower 114 contacts are electrically open, as described in more detail in FIGS. 3 and 4.

Referring now to FIGS. 3 and 4, the operation of the fuse assembly, 150 for the electrical cutout 20 is shown in more detail. The fuse assembly 150 has an upper contact end 152 and a lower contact end 154. The fuse assembly 150 also has a circular ring member 162 located near the upper contact end 52 for inserting a hot stick used by a utility company lineman to engage and replace the fuse assembly 150. The upper contact end 152 is guided into an engaged position by the guide members 55, 56 attached to the upper bracket 52 of the upper line terminal assembly 50. The lower contact end 154 of the fuse assembly 150 is pivotally mounted to the lower line terminal assembly 100 by a transverse shaft member 180 attached to the longitudinal fuse assembly 150. A fuse element 170 located within the fuse assembly 150 extends between the upper 74 and lower 114 contacts and has a fuse element line 174 (not shown) extending the approximate length of the fuse element 170 and across the lower contact end 154.

As shown in FIG. 3, the fuse assembly 150 is in the engaged position. When a high power surge comes down the electrical cables 25 onto the upper line terminal assembly 50, it crosses the upper contact end 152 of the fuse assembly 150 and blows the fuse element 170. The fuse element 170, in turn, releases the engaging pressure on the upper contact 152 by released tension on the fuse element line 174. The released tension causes the fuse assembly 150 to slightly drop vertically downward, and the upper contact end 152 of the fuse assembly 150 then swings outward and down to a disengaged and electrically open position as shown in FIG. 4.

FIGS. 5–8 are now discussed in more detail to describe the construction of the electrical insulator 30 for the electrical cutout 20. As described above, the insulator 30 in FIGS. 5–8 has an elongated central stem portion 32 defining a longitudinal direction, and a plurality of longitudinally spaced apart skirts 34 mounted to the stem portion 32 and so as to lie in respective transverse planes which are perpendicular to the longitudinal direction. Also, the longitudinally space apart skirts 34 are arranged and constructed so as to have a smaller diameter skirt directly above or below a larger diameter skirt. The skirts 34 are formed so as to have tips sloping in a downward direction to allow water or other contaminants to drain therefrom.

Figure 5:
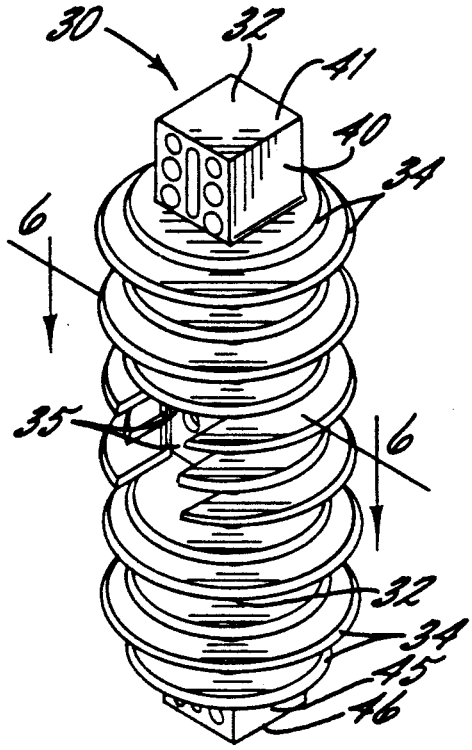
FIG. 5 is a perspective view of the insulator for the electrical cutout according to the present invention.
Figure 6:
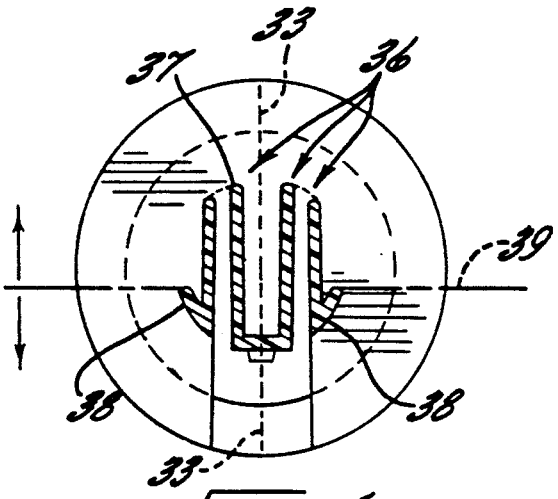
FIG. 6 is a transverse cross-sectional view of the insulator shown in FIG. 5 taken along line 6—6.

In FIG. 6 is shown a transverse cross-sectional view taken along line 6—6 of FIG. 5. This view shows the spaced apart segments 36 of the central stem portion 32. The insulator 30 further has a central axis 33 extending perpendicular to the longitudinal direction (shown by the dotted line in FIG. 6). The elongated central stem portion 32 of the insulator 30 has a non-solid cross-sectional configuration. The spaced apart segments 36 are symmetrical about the central axis 33 of the insulator 30 and include a generally U-shaped centrally located segment 37 and a generally J-shaped segment 38 on each side of the U-shaped segment 37. These outer J-shaped segments 38 are generally mirror images of each other, particularly because of the symmetrical orientation of the segments 36 about the central axis 33.

This insulator configuration allows for non-uniform tracking or creep distance between insulator skirts 34 and, thereby, increases the overall tracking distance for the insulator 30. This configuration balances the tradeoff achieved when designing an insulator 30 for both mechanical strength and maximum creep distance to prevent the problems encountered with conventional insulators. It also allows the use of one material to prevent the potential of material-electrical incompatibility problems. In addition, the configuration allows for similar mechanical strength or stiffness of the insulator 30 in a direction along the central axis 33 and a direction perpendicular to the central axis 33 with minimum insulator material requirements and uniform wall thickness.

Figure 7:
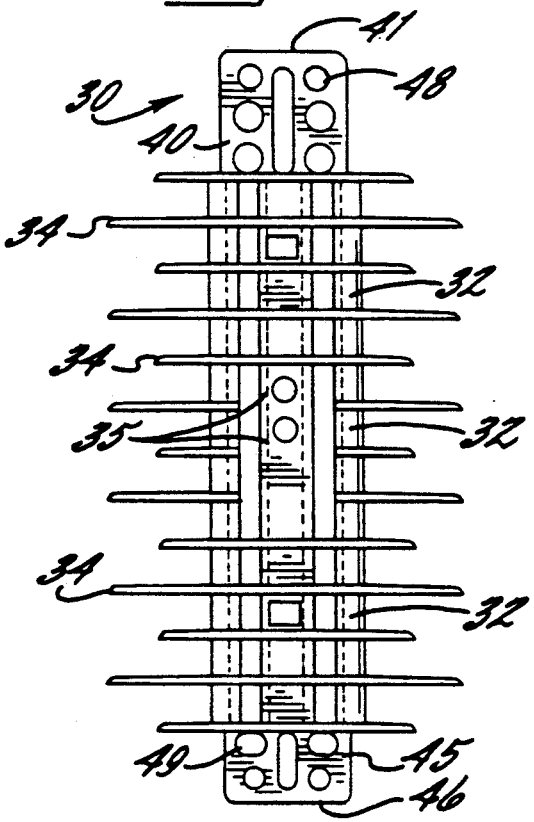
FIG. 7 is a rear plan view of the insulator for the electrical cutout.
Figure 8:
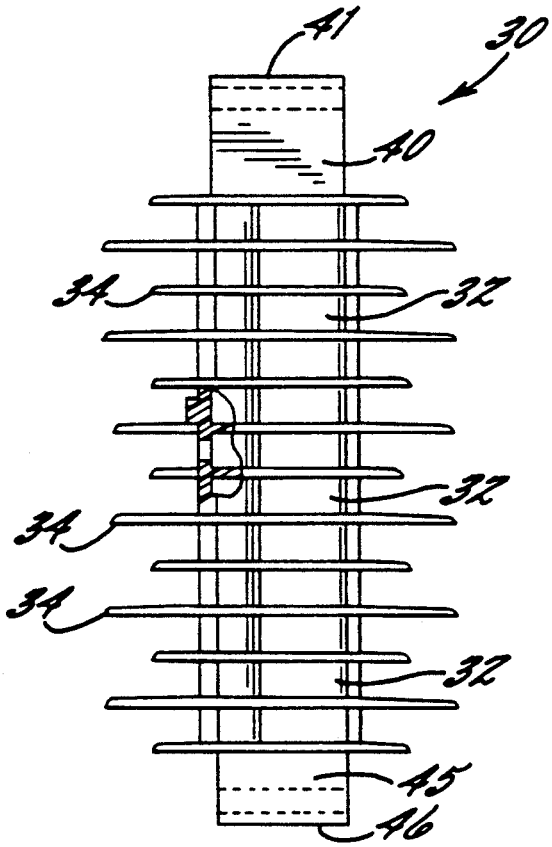
FIG. 8 is a side plan view of the insulator for the electrical cutout with parts broken away for clarity.

Referring now to FIGS. 5 and 7, the upper mounting post 40 has a plurality of perforations 48 therethrough for attachment of the upper bracket 52 and to maintain uniform wall thickness. The lower mounting post 45 also has a plurality of perforations 49 therethrough for attachment of the lower bracket 102 and to maintain uniform wall thickness, but as seen in FIG. 7 a smaller number of perforations than the upper mounting post 40. Both sets of perforations 48, 49 in the mounting posts 40, 45 also have a symmetrical relation about the central axis 33 of the insulator 30.

The insulator 30 is injection molded as one part using a mold made of two half sections and is formed from a plastic or polymeric material. The two half sections for molding purposes are shown in FIG. 6 as divided along the dashed line 39. The plastic insulator 30 is capable of being injection molded because of its relatively uniform, thin wall-thickness design and its symmetrical orientation about the central axis 33. The insulator material is preferably polybutylterepthalate ("PBT") and is thirty percent (30%) by Weight glass fiber filled for added strength. The PBT is preferably flame retardant such as found in the Celanex No. 3316 product from Hoechst Celanese. The insulator material also preferably utilizes additives such as tri-hydrated alumina filler ("THA")

for increased electrical tracking resistance. An ultraviolet ("UV") silicon based polymer material, such as UVHC8550-D1 manufactured by General Electric Silicones, is applied to the molded plastic insulator 30 by spraying or dipping the insulator 30 with the material. The insulator 30 is then exposed to UV light to polymerize and form a UV hardcoat thereon. The UV hardcoat increases resistance of the plastic insulator 30 to environmental degradation over time due to exposure to sun, rain, dirt, and the like.

Figure 9:
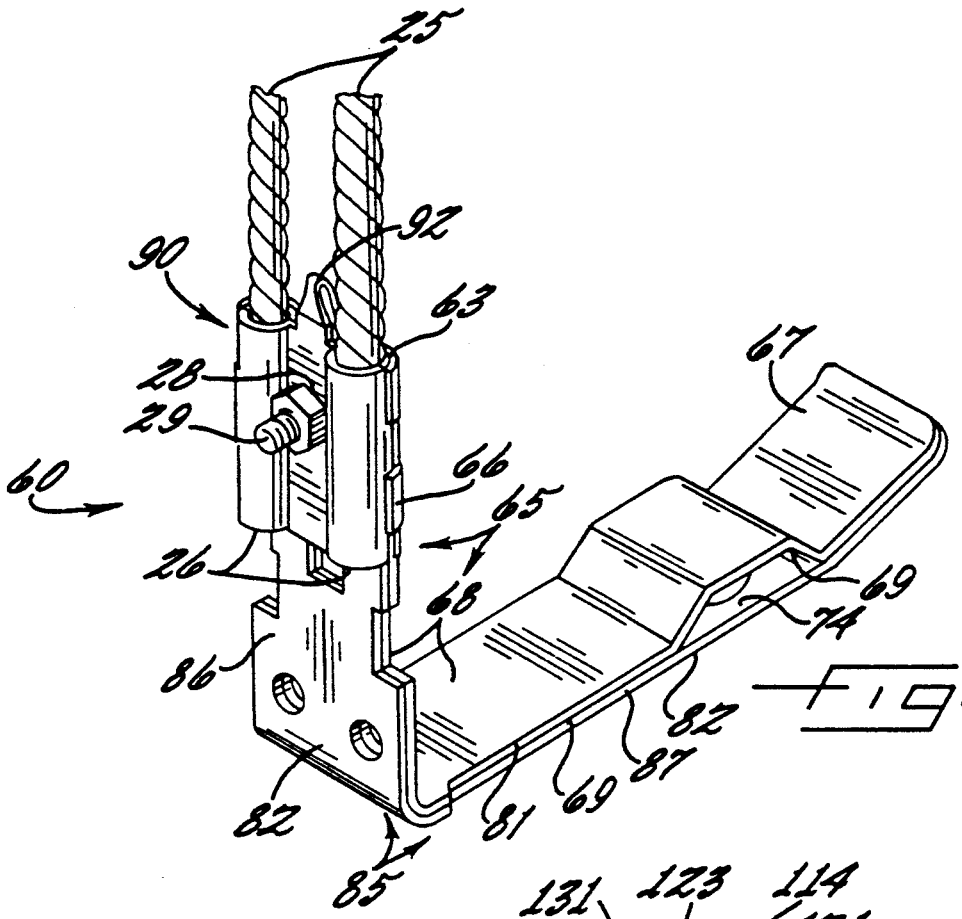
FIG. 9 is a perspective view of an assembled upper line clamp of the upper line assembly for the electrical cutout according to an embodiment of the present invention.
Figure 10:
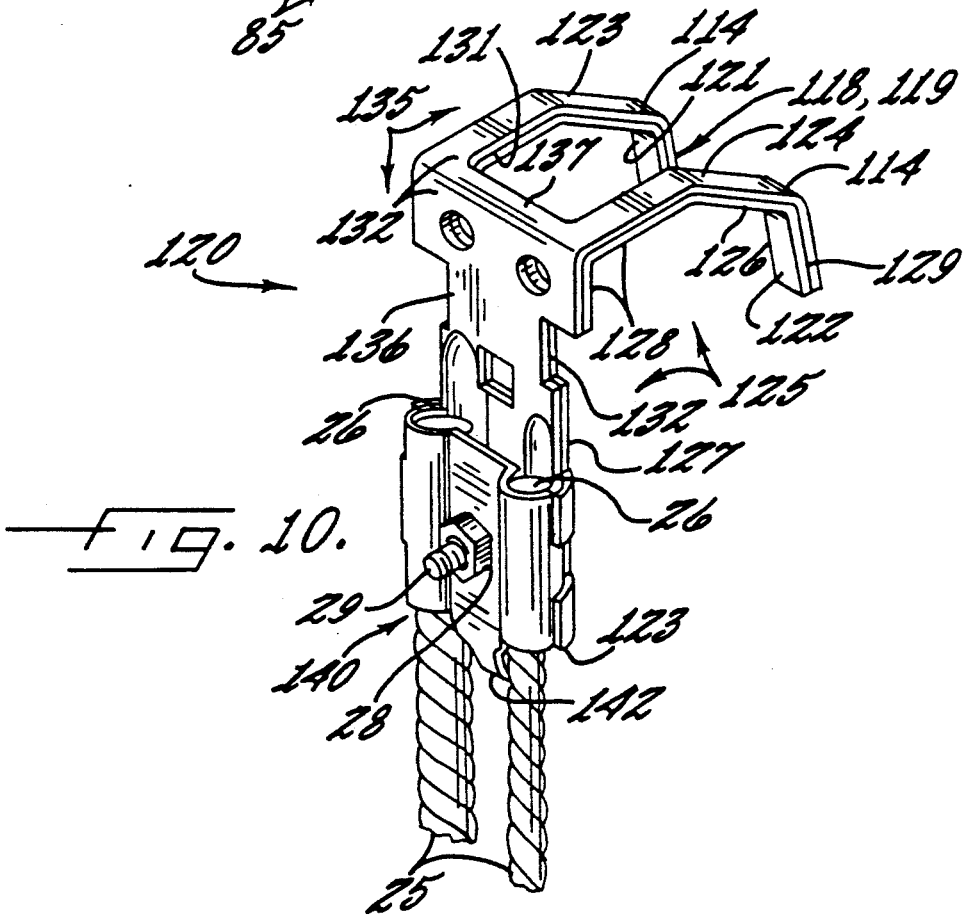
FIG. 10 is a perspective view of an assembled lower line clamp of the lower line assembly for the electrical cutout according to an embodiment of the present invention.

FIGS. 9 and 10 are now described to show the folding over of the upper 60 and lower 120 line clamps of the upper 50 and lower 100 line terminal assemblies for the electrical cutout 20 according to an alternative embodiment of the present invention. Each of the line clamps 60, 120 has a first metallic plate member 65, 125 having first 66, 126 and second 67, 127 legs disposed in a generally L-shaped arrangement and so as to define an inside surface 68, 128 on the inside of the L and an opposite outside surface 69, 129 on the outside of the L.

A second metallic plate member 85, 135 having first 86, 136 and second 87, 137 legs disposed in a generally L-shaped arrangement and which closely conform to the size and configuration of the first plate member 65, 125. The second plate member 85, 135 also has an inside 81, 131 and an outside 82, 132 surface. The second plate member 85, 135 is secured to the first plate member 65, 125 so as to overlie the outside surface 69, 129 of the first plate member 65, 125. The first 86, 136 and second 87, 137 legs of the second plate member 85, 135 respectively overlie the first 66, 126 and second 67, 127 legs of the first plate member 65, 125.

Clamp means 90, 140 is provided for interconnecting the first 65, 125 and second 85, 135 plate members. The clamp means 90, 140 is also attached to the first plate member 65, 125 along one end 63, 123 of first leg 66, 126. The clamp means 90, 140 folds over by means of a segment 92, 142 of reduced width upon and into engagement with the first leg 86, 136 of the second plate member 85, 135 to thereby secure an end portion 26 of the electrical cables 25 between the clamp means 90, 140 and into direct electrical contact with the outside surface 82, 132 of the first leg 86, 136 of the second plate member 85, 135. The first 65, 125 and second 85, 135 plate members and the clamp means 90, 140 have openings extending through the inside 68, 128, 81, 131 and outside surfaces 69, 129, 82, 132 of the first legs 66, 126, 86, 136 of the first 65, 125 and second 85, 135 plate members, and a bolt 29 extending through the openings 28 to help secure the end portion 26 of the electrical cables 25. The second leg 87, 137 of the second plate member 85, 135 is exposed for direct electrical contact with the fuse assembly 150.

The second legs 126, 137 of the first 125 and second 135 plate members of the lower line clamp 120 also form opposite side plate portions 121, 122, 123, 124 and a medial open spaced portion 118, 119 therebetween respectively. The opposite side plate portions 123, 124 of the second plate member 135 also form the lower contact 114 for the fuse assembly 150.

In the upper 60 and lower 120 line clamps for the electrical cutout 20, the second plate member 85, 135 is formed of a metallic material, such as copper, brass, bronze or aluminum, having a higher electrical conductivity than the first plate member 65, 125, formed of a metallic material such as steel. The clamping force is provided only by the first leg 66, 126 and the clamp means 90, 140 of the first plate member 65, 125. Since the first plate member 65, 125 has very little electrical conductivity (i.e., formed of steel), the second plate member 85, 135 (i.e., formed of copper) provides the electrical current path with the highest electrical efficiency for contact between the electrical cables 25 and the fuse assembly 150.

Figure 11:
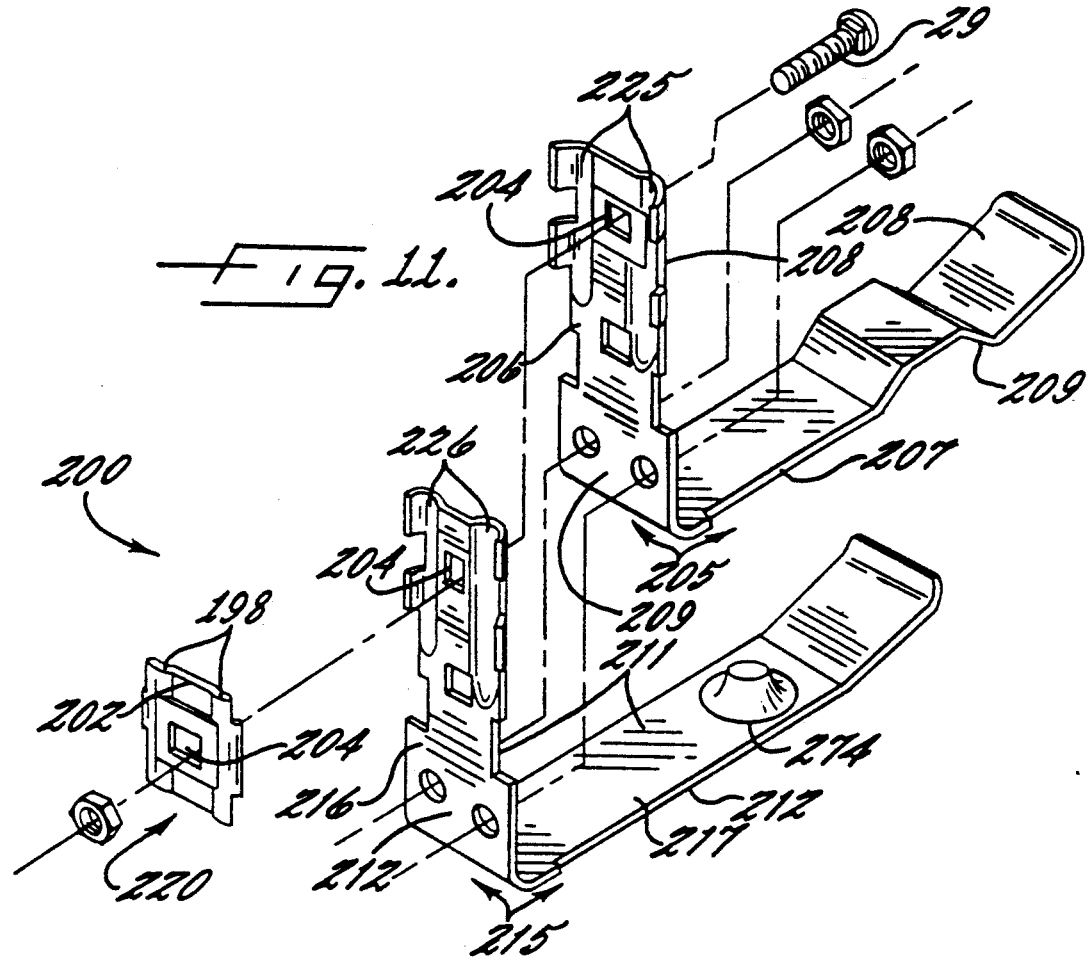
FIG. 11 is an exploded perspective view of the upper line clamp of the upper line terminal assembly for the electrical cutout according to a preferred embodiment of the present invention.
Figure 12:
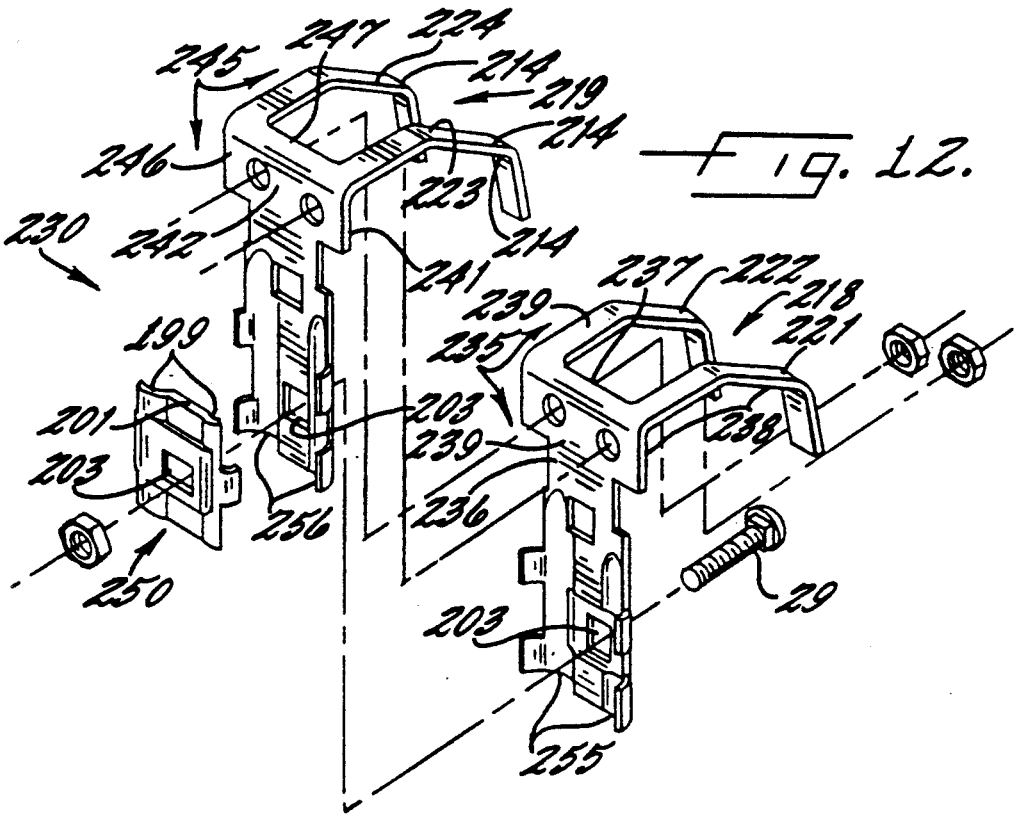
FIG. 12 is an exploded perspective view of the lower line clamp of the lower line terminal assembly for the electrical cutout according to a preferred embodiment of the present invention.

FIGS. 11 and 12 hereinafter are discussed to describe in more detail the upper 200 and lower 230 line clamps of the upper line terminal assembly 50 and the lower line terminal assembly 100 respectively for the electrical cutout 20 according to a preferred embodiment of the present invention. The exploded views of FIGS. 11 and 12 also apply to the embodiment of FIGS. 9 and 10 except that the clamp means 90, 140 is attached to the first plate member 65, 125 along one end 63, 123 of the first leg 66, 126 as described in the embodiment of FIGS. 9 and 10.

The line clamps 200, 230 as shown in FIGS. 11–12, similar to FIGS. 9–10, each have a first metallic plate member 205, 235 having first 206, 236 and second 207, 237 legs disposed in a generally L-shaped arrangement and so as to define an inside surface 208, 238 on the inside of the L and an opposite outside surface 209, 239 on the outside of the L. The line clamps 200, 230 also have a second metallic plate member 215, 245 having first 216, 246 and second 217, 247 legs disposed in a generally L-shaped arrangement and which closely conform to the size and configuration of the first plate member 205, 235. The second plate member 215, 245 also has an inside 211, 241 and an outside 212, 242 surface. The second plate member 215, 245 is secured to the first plate member 205, 235 so as to overlie the outside surface 209, 239 of the first plate member 205, 235 and with the first 216, 246 and second 217, 247 legs of the second plate member 215, 245 respectively overlying the first 206, 236 and second 207, 237 legs of the first plate member 205, 235.

Clamp means 220, 250 is also provided for interconnecting the first 205, 235 and second 215, 245 plate members and for securing the end portion 26 of the electrical cables 25 into direct engagement with the outer surface 209, 239 of the first leg 216, 246 of the second plate member 215, 235, and such that the second leg 217, 247 of the second plate member 215, 245 is exposed for direct electrical contact with the fuse assembly 150 or the like. The clamp means 220, 250 has a separate clamp plate 201, 202 overlying the first leg 216, 246 of the second plate member 215, 245, aligned openings 203, 204 in the clamp plate 201, 202 and first legs 206, 236, 216, 246 of the first 205, 235 and second 215, 245 plate members, and a bolt 29 extending through the aligned openings 203, 204 for securing the clamp plate 201, 202 to the first legs 206, 236, 216, 246 of the first 205, 235 and second 215, 245 plate members. The clamp means 220, 250 that holds the electrical cables 25 into engagement with the outer surface 219, 249 of the first leg 216, 246 of the second plate member 215, 245 does not provide the conductivity for the electrical contact to the fuse assembly 150.

The second legs 237, 247 of the first 235 and second 245 plate members of the lower line clamp 230 also form opposite side plate portions 221, 222, 223, 224 and a medial open spaced portion 218, 219 therebetween respectively. The opposite side plate portions 223, 224 of the second plate member 245 also form the lower contact 214 for the preferred embodiment of the clamp assemblies 200, 230 for engagement with the fuse assembly 150.

In the upper 200 and lower 230 line clamps for the electrical cutout 20, the second plate member 215, 245, as in FIGS. 9 and 10, is formed of a metallic material, such as copper, brass, bronze or aluminum, having a higher electrical conductivity than that of the first plate member 205, 235, formed of a metallic material such as steel. The clamping force is provided only by the first leg 206, 236 and the clamp plate 201, 202 of the clamp means 220, 250 of the first plate member 205, 235. Since the first plate member 205, 235 has very little electrical conductivity (i.e., formed of steel), the second plate member 215, 245 (i.e., formed of copper) provides the electrical current path with the highest electrical efficiency for contact between the electrical cables 25 and the fuse assembly 150.

The first leg 206, 236 of the first plate members 205, 235 also includes in this preferred embodiment, like the alternative embodiment, two longitudinally extending channels 225, 255 of arcuate cross-sectional configuration formed therein. The first leg 216, 246 of the second plate member 215, 245 includes channels 226, 256 of like configuration and which are partially received in the channels 225, 256 of the first leg 206, 236 of the first plate member 205, 235. The channels 226, 256 in the first leg 216, 246 of the second plate member 215, 245 is adapted to partially receive the end portion 26 of the electrical cables 25 or the like and be held therein by the clamp means 220, 250. The clamp plate 201, 202 of the clamp means 220, 250 also have channels 198, 199 to partially receive the end portion 26 of the electrical cables 25. Although FIGS. 11 and 12 show electrical cables of the same size clamped into engagement, the channels 225, 255, 226, 256, 198, 199 themselves are adapted to allow different sizes of electrical cable 25 as shown in the figures therein. This description of the channels 216, 246, 226, 256 in the first 205, 235 and second 215, 245 plate members of FIGS. 11 and 12 also applies to the embodiments of FIGS. 9 and 10. In addition, one or more than two channels could also be used for adapting the first 205, 235 and second 215, 245 plate members to receive the electrical cable 25.

In the drawings and specification, there have been disclosed typical preferred embodiments of the invention and, although specific terms are employed, they are used in a generic and descriptive sense only and not for the purposes of limitation, the scope of the invention being set forth in the following claims.

That which is claimed is:

1. An electrical cutout, comprising:

an insulator comprising an elongated central stem portion defining a longitudinal direction, and a plurality of longitudinally spaced apart skirts mounted to said stem portion and so as to lie in respective planes which are transverse to said longitudinal direction, said elongated central stem portion comprising at least one region which is non-solid and non-cylindrical when viewed in a transverse cross-section between said skirts;

an upper line terminal assembly mounted to one end of said insulator and including means for attaching an electrical cable thereto and an upper electrical contact;

a lower line terminal assembly mounted to the other end of said insulator and including means for attaching an electrical cable thereto and a lower electrical contact; and a fuse assembly pivotally mounted to said other end of said insulator for pivotal movement between an operative position engaging and electrically closing said upper and lower contacts and an inoperative position wherein said upper and lower contacts are electrically open.

2. An electrical cutout according to claim 1, wherein said elongated central stem portion of said insulator further comprises a plurality of spaced apart solid segments when viewed in transverse cross section.

3. An electrical cutout according to claim 2, wherein said insulator defines a central axis extending perpendicular to said longitudinal direction, said segments of said elongated central stem portion being symmetrical about said central axis.

4. An electrical cutout according to claim 2, wherein said solid segments include a generally U-shaped segment.

5. An electrical cutout according to claim 4, wherein said U-shaped segment is centrally located and wherein said solid segments further comprise an outer segment on each side of said U-shaped segment, one of said outer segments being generally J-shaped, and the other of said outer segments being shaped as a mirror image of said J-shaped segment.

6. An electrical cutout, according to claim 1, further comprising a mounting post which is in the form of a rectangular solid mounted at each end of said central stem portion and wherein said plurality of longitudinally spaced apart skirts mounted to said stem portion lie in respective transverse planes which are generally perpendicular to said longitudinal direction.

7. An electrical cutout according to claim 1, wherein said insulator is composed essentially of a polymeric material.

8. An electrical cutout according to claim 7, wherein said polymeric insulator material comprises polybutylterephthalate.

9. An electrical cutout, comprising:

a polymeric insulator comprising an elongated central stem portion defining a longitudinal direction, and a plurality of longitudinally spaced apart skirts mounted to said stem portion and so as to lie in respective planes which are transverse to said longitudinal direction, said elongated central stem portion comprising a plurality of spaced apart, non-interconnected solid segments when viewed in a transverse cross section between said skirts;

an upper line terminal assembly mounted to one end of said insulator and including means for attaching an electrical cable thereto and an upper electrical contact;

a lower line terminal assembly mounted to the other end of said insulator and including means for attaching an electrical cable thereto and a lower electrical contact; and a fuse assembly pivotally mounted to said other end of said insulator for pivotal movement between an operative position engaging and electrically closing said upper and lower contacts and an inoperative position wherein said upper and lower contacts are electrically open.

10. An electrical cutout according to claim 9, wherein said insulator defines a central axis extending perpendicular to said longitudinal direction, said segments of said elongated central stem portion being symmetrical about said central axis.

11. An electrical cutout according to claim 9, wherein said spaced apart segments of said stem portion of said insulator include a generally U-shaped centrally located segment, and an outer segment on each side of said U-shaped segment.

12. An electrical cutout according to claim 11, wherein one of said outer segments is generally J-shaped, and the other of said outer segments is shaped as a mirror image of said J-shaped segment.

13. An electrical cutout, according to claim 9, further comprising a mounting post which is in the form of a rectangular solid mounted at each end of said central stem portion and wherein said plurality of longitudinally spaced apart skirts mounted to said stem portion lie in respective transverse planes which are generally perpendicular to said longitudinal direction.

14. An electrical cutout according to claim 9, wherein said insulator is composed essentially of a polymeric material.

15. An electrical cutout according to claim 14, wherein said polymeric insulator material comprises polybutylterephthalate.

16. An insulator for an electrical cutout, comprising:

an elongated central stem portion defining a longitudinal direction; and a plurality of longitudinally spaced apart skirts mounted to said stem portion and so as to lie in respective planes which are transverse to said longitudinal direction, said elongated central stem portion comprising at least one region which is non-solid and non-cylindrical when viewed in a transverse cross-section between said skirts.

17. An insulator for an electrical cutout according to claim 16, wherein said elongated central stem portion further comprises a plurality of spaced apart solid segments when viewed in transverse cross section.

18. An insulator for an electrical cutout according to claim 17, further comprising a central axis extending perpendicular to said longitudinal direction, said segments of said elongated central stem portion being symmetrical about said central axis.

19. An insulator for an electrical cutout according to claim 18, wherein said solid segments include a generally U-shaped segment.

20. An insulator for an electrical cutout according to claim 19, wherein said U-shaped segment is centrally located and wherein said solid segments further comprise an outer segment on each side of said U-shaped segment, one of said outer segments being generally J-shaped, and the other of said outer segments being shaped as a mirror image of said J-shaped segment.

21. An insulator for an electrical cutout according to claim 16, further comprising a mounting post which is in the form of a rectangular solid mounted at each end of said central stem portion and wherein said plurality of longitudinally spaced apart skirts mounted to said stem portion lie in respective transverse planes which are generally perpendicular to said longitudinal direction.

22. An insulator for an electrical cutout according to claim 16, wherein said insulator is composed essentially of a polymeric material.

23. An insulator for an electrical cutout according to claim 22, wherein said polymeric insulator material comprises polybutylterephthalate.

24. A polymeric insulator for an electrical cutout, comprising:

an elongated central stem portion defining a longitudinal direction and a plurality of longitudinally spaced apart skirts mounted to said stem portion and so as to lie in respective planes which are transverse to said longitudinal direction, said elongated central stem portion comprising a plurality of spaced apart, non-interconnected solid segments when viewed in a transverse cross-section between said skirts.

25. An insulator for an electrical cutout according to claim 24, further comprising a central axis extending perpendicular to said longitudinal direction, said segments of said elongated central stem portion being symmetrical about said central axis.

26. An insulator for an electrical cutout according to claim 24, wherein said segments include a generally U-shaped centrally located segment, and an outer segment on each side of said U-shaped segment.

27. An insulator for an electrical cutout according to claim 26, wherein one of said outer segments is generally J-shaped, and the other of said outer segments is shaped as a mirror image of said J-shaped segment.

28. An insulator for an electrical cutout according to claim 24, further comprising a mounting post which is in the form of a rectangular solid mounted at each end of said central stem portion and wherein said plurality of longitudinally spaced apart skirts mounted to said stem portion lie in respective transverse lanes which are generally perpendicular to said longitudinal direction.

29. An insulator for an electrical cutout according to claim 24, wherein said insulator is composed essentially of a polymeric material.

30. An insulator for an electrical cutout according to claim 29, wherein said polymeric insulator material comprises polybutylterepthalate.

31. An electrical cutout, comprising:

an insulator comprising an elongated central stem portion defining a longitudinal direction, and a plurality of longitudinally spaced apart skirts mounted to said stem portion and so as to lie in respective planes which are transverse to said longitudinal direction;

an upper line terminal assembly mounted to one end of said insulator and including means for attaching an electrical cable thereto and an upper electrical contact;

a lower line terminal assembly mounted to the other end of said insulator and including means for attaching an electrical cable thereto and a lower electrical contact;

said upper and lower line terminal assemblies each having a first metallic plate member comprising first and second legs disposed in a generally L-shaped arrangement and so as to define an inside surface on the inside of the L and an opposite outside surface on the outside of the L, a second metallic plate ember comprising first and second legs disposed in a generally L-shaped arrangement and which closely conform to the size and configuration of said first plate member, and with said second plate member being secured to said first plate member so as to overlie said outside surface of said first plate member and with said first and second legs of said second plate member respectively overlying the first and second legs of said first plate member, and clamp means for interconnecting said first and second plate members and for securing the end portion of an electrical cable into direct engagement with the outer surface of said first leg of said second plate member, said first legs of said first and second plate members of each of said upper and lower line terminal assemblies include a segment of reduced width at a medial location along the lengths thereof and so as to define an outer portion and an inner portion of said first legs, and wherein each of said clamp means comprises said outer portion which has been folded over upon said inner portion such that portions of said first leg of said second plate member oppose each other and are adapted to grip an electrical cable therebetween; and a fuse assembly pivotally mounted to said other end of said insulator for pivotal movement between an operative position engaging and electrically closing said upper and lower contacts of said line terminal assemblies and an inoperative position wherein said upper and lower contacts are electrically open and such that the second leg of said second plate member of each of the upper and lower line terminal assemblies is exposed for direct electrical contact with said fuse assembly.

32. An electrical cutout according to claim 31, wherein said elongated central stem portion of said insulator comprises non-solid and non-cylindrical regions when viewed in a transverse cross-section between said skirts.

33. An electrical cutout according to claim 32, wherein said elongated central stem portion of said insulator further comprises a plurality of spaced apart segments when viewed in transverse cross section.

34. An electrical cutout according to claim 33, wherein said insulator further comprises a central axis extending perpendicular to said longitudinal direction, said segments of said elongated central stem portion being symmetrical about said central axis.

35. An electrical cutout according to claim 31, further comprising a mounting post which is in the form of a rectangular solid mounted at each end of said central stem portion of said insulator and wherein said plurality of longitudinally spaced apart skirts mounted to said stem portion lie in respective transverse planes which are generally perpendicular to said longitudinal direction.

36. An electrical cutout according to claim 31, wherein each of said clamp means further comprising aligned openings extending through said inner and outer portions, and a bolt extending through said openings.

37. An electrical cutout according to claim 31, wherein said first leg of said first plate member of each of said upper and lower line terminal assemblies includes at least one longitudinally extending channel of arcuate cross sectional configuration formed therein, and said first leg of said second plate member includes a channel of like configuration and which is partially received in said channel in said first leg of said first plate member, and such that said channel in said first leg of said second plate member is adapted to partially receive the end portion of an electrical cable or the like and be held therein by said clamp means.

38. A line terminal assembly adapted for use in an electrical cutout or the like, comprising:

a first metallic plate member having first and second legs disposed in a generally L-shaped arrangement and so as to define an inside surface on the inside of the L and an opposite outside surface on the outside of the L;

a second metallic plate member having first and second legs disposed in a generally L-shaped arrangement and which closely conform to the size and configuration of said first plate member, and with said second plate member being secured to said first plate member so as to overlie said outside surface of said first plate member and with said first and second legs of said second plate member respectively overlying the first and second legs of said first plate member; and clamp means for interconnecting said first and second plate members and for securing the end portion of an electrical cable into direct engagement with the outside surface of said first leg of said second plate member, and such that the second leg of said second plate member is exposed for direct electrical contact with a fuse assembly or the like;

and wherein said first legs of said first and second plate members include a segment of reduced width at a medial location along the lengths thereof and so as to define an outer portion and an inner portion of said first legs, and wherein said clamp means comprises said outer portion which has been folded over upon said inner portion such that portions of said first leg of said second plate member oppose each other and are adapted to grip an electrical cable therebetween.

39. A line terminal assembly according to claim 38, further comprising aligned openings extending through said inner and outer portions, and a bolt extending through said openings.

40. A line terminal assembly according to claim 38, wherein said first leg of said first plate member includes at least one longitudinally extending channel of arcuate cross sectional configuration formed therein, and said first leg of said second plate member includes a channel of like configuration and which is partially received in said channel in said first leg of said first plate member, and such that said channel in said first leg of said second plate member is adapted to partially receive the end portion of an electrical cable or the like and be held therein by said clamp means.

41. A line terminal assembly according to claim 38, wherein said second legs of said first and second plate members each further comprises elongate opposite side plate portions and an open space therebetween.

42. A line terminal assembly according to claim 38, wherein said second plate member is formed of a metallic material having a higher electrical conductivity than that of said first plate member.

43. A line terminal assembly according to claim 42, wherein said metallic material of said second plate member is comprised essentially of copper or aluminum.

44. A line terminal assembly according to claim 42, wherein said metallic material of said first plate member is comprised essentially of steel.

45. An electrical cutout, comprising:

an insulator comprising an elongated central stem portion defining a longitudinal direction, and a plurality of longitudinally spaced apart skirts mounted to said stem portion and so as to lie in respective planes which are transverse to said longitudinal direction;

an upper line terminal assembly mounted to one end of said insulator and including means for attaching an electrical cable thereto and an upper electrical contact;

a lower line terminal assembly mounted to the other end of said insulator and including means for attaching an electrical cable thereto and a lower electrical contact;

said upper and lower line terminal assemblies each having a first metallic plate member comprising first and second legs disposed in a generally L-shaped arrangement and so as to define an inside surface on the inside of the L and an opposite outside surface on the outside of the L, a second metallic plate member comprising first and second legs disposed in a generally L-shaped arrangement and which closely conform to the size and configuration of said first plate member, and with said second plate member being secured to said first plate member so as to overlie said outside surface of said first plate member and with said first and second legs of said second plate member respectively overlying the first and second legs of said first plate member, and clamp means for interconnecting said first and second plate members and for securing the end portion of an electrical cable into direct engagement with the outer surface of said first leg of said second plate member, said first leg of said first plate member of each of said upper and lower line terminal assemblies includes at least one longitudinally extending channel of arcuate cross sectional configuration formed therein, and said first leg of said second plate member includes a channel of like configuration and which is partially received in said channel in said first leg of said first plate member, and such that said channel in said first leg of said second plate member is adapted to partially receive the end portion of an electrical cable or the like and be held therein by said clamp means; and a fuse assembly pivotally mounted to said other end of said insulator for pivotal movement between an operative position engaging and electrically closing said upper and lower contacts of said line terminal assemblies and an inoperative position wherein said upper and lower contacts are electrically open and such that the second leg of said second plate member of each of the upper and lower line terminal assemblies is exposed for direct electrical contact with said fuse assembly.

46. An electrical cutout according to claim 45, wherein each of said clamp means comprises a separate clamp plate overlying said first leg of said second plate member, aligned openings in said clamp plate and said first legs of said first and second plate members, and a bolt extending through said aligned openings for securing said clamp plate to said first legs of said first and second plate members.

47. A line terminal assembly adapted for use in an electrical cutout or the like, comprising:

a first metallic plate member having first and second legs disposed in a generally L-shaped arrangement and so as to define an inside surface on the inside of the L and an opposite outside surface on the outside of the L;

a second metallic plate member having first and second legs disposed in a generally L-shaped arrangement and which closely conform to the size and configuration of said first plate member, and with said second plate member being secured to said first plate member so as to overlie said outside surface of said first plate member and with said first and second legs of said second plate member respectively overlying the first and second legs of said first plate member; and clamp means for interconnecting said first and second pate members and for securing the end portion of an electrical cable into direct engagement with the outside surface of said first leg of said second plate member, and such that the second leg of said second plate member is exposed for direct electrical contact with a fuse assembly or the like;

and wherein said first leg of said first plate member of each of said upper and lower line terminal assemblies includes at least one longitudinally extending channel of arcuate cross sectional configuration formed therein, and said first leg of said second plate member includes a channel of like configuration and which is partially received in said channel in said first leg of said first plate member, and such that said channel in said first leg of said second plate member is adapted to partially receive the end portion of an electrical cable or the like and be held therein by said clamp means.

48. A line terminal assembly according to claim 47, wherein said clamp means comprises a separate clamp plate overlying said first leg of said second plate member, aligned openings in said clamp plate and said first legs of said first and second plate members, and a bolt extending through said aligned openings for securing said clamp plate to said first legs of said first and second plate members.

* * * * *

UNITED STATES PATENT AND TRADEMARK OFFICE

CERTIFICATE OF CORRECTION

PATENT NO. : 5,300,912

DATED : April 5, 1994

INVENTOR(S) : Tillery et al.

It is certified that error appears in the above-identified patent and that said Letters Patent is hereby corrected as shown below:

Column 1, line 11, after "A cutout" delete -- or sectionalizer --.

Column 6, line 64, "Weight" should be -- weight --.

Column 12, line 53, "ember" should be -- member --.

Column 16, line 22, "pate" should be -- plate --.

Signed and Sealed this

Ninth Day of August, 1994

*Attest:*

Bruce Lehman

BRUCE LEHMAN

*Attesting Officer*

*Commissioner of Patents and Trademarks*